US007291076B2

(12) United States Patent
Watanabe

(10) Patent No.: US 7,291,076 B2
(45) Date of Patent: Nov. 6, 2007

(54) GOLF BALL

(75) Inventor: Hideo Watanabe, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 124 days.

(21) Appl. No.: 11/180,682

(22) Filed: Jul. 14, 2005

(65) Prior Publication Data

US 2007/0015602 A1 Jan. 18, 2007

(51) Int. Cl.
*A63B 37/12* (2006.01)

(52) U.S. Cl. ..... 473/378

(58) Field of Classification Search ..... 473/378, 473/351, 373, 374

See application file for complete search history.

(56) References Cited

U.S. PATENT DOCUMENTS 6,558,277 B1 * 5/2003 Ohira et al. ..... 473/378

2004/0176531 A1 * 9/2004 Morgan et al. ..... 524/590

FOREIGN PATENT DOCUMENTS

| | | |
|---|---|---|
| JP | 6-170013 A | 6/1994 |
| JP | 2000-254251 A | 9/2000 |
| JP | 2004-081350 A | 3/2004 |

* cited by examiner

*Primary Examiner*—Raeann Trimiew
(74) *Attorney, Agent, or Firm*—Sughrue Mion Pllc.

(57) ABSTRACT

A golf ball composed of a solid core of at least one layer and a cover of at least one layer is characterized in that the solid core or an inner cover layer adjacent to an outer cover layer has a color difference ΔE with a ball surface of at most 30, and at least the outer cover layer is transparent or translucent and made of a resin material that includes an interference pigment in which color develops through an interference effect by reflected light. The golf ball is stylish and has a high-quality feel, yet also has an excellent scuff resistance.

11 Claims, No Drawings

GOLF BALL

BACKGROUND OF THE INVENTION

The present invention relates to a lady's golf ball which has a distinctive appearance and excellent scuff resistance, and appeals particularly to lady golfers.

In the technical field relating to golf balls, various innovations are commonly made to improve ball performance, including carry, feel, controllability and durability. In addition to these ball performance characteristics, there has existed over the past few years a growing demand for a ball appearance that is visually novel, available in color variations which women are fond of, and has a soft, pastel feel. A number of golf balls which are finished to a more attractive appearance and are highly stylish have recently been disclosed in the art.

Such golf balls have been described in, for example, JP-A 6-170013, JP-A 2004-81350, and JP-A 2000-254251 (and the corresponding U.S. Pat. No. 6,558,277). These golf balls have been made highly stylish by including an interference pigment and a polarizing material in a layer of paint applied to the surface of the ball.

However, in these prior-art golf balls, if the surface of the ball is even slightly marred by use, the affected area becomes conspicuous and diminishes the impression one has of the ball's appearance.

Also, most prior-art golf balls are white. Although a small number of orange, yellow or other fluorescent colored golf balls have been used, balls of this sort lack a high-quality feel. Golf balls in such colors as light blue, pink and green similarly lack a sufficient sense of quality, leaving substantial room for improvement.

It is therefore an object of the present invention to provide a golf ball which has a distinctive appearance and is highly stylish, and thus particularly well-suited for use as a lady's golf ball, and which moreover has an excellent scuff resistance.

SUMMARY OF THE INVENTION

As a result of extensive investigations, we have discovered that by giving the solid core of the ball a vivid color and by adding to a substantially transparent cover resin material an interference pigment in which color develops through an interference effect by reflected light, a golf ball can be achieved which is both stylish and has a high-quality feel, and which moreover is able to retain both its stylishness and sense of quality even when the surface of the ball is marred.

Accordingly, the invention provides the following golf ball.

[1] A golf ball composed of a solid core of at least one layer and a cover of at least one layer, which golf ball is characterized in that the solid core or an inner cover layer adjacent to an outer cover layer has a color difference ΔE with a ball surface of at most 30, and at least the outer cover layer is transparent or translucent and made of a resin material that includes an interference pigment in which color develops through an interference effect by reflected light.

[2] The golf ball of [1] above, wherein the solid core has a color selected from the group consisting of pink, yellow, blue and orange.

[3] The golf ball of [1] above, wherein the cover has a total thickness of at least 1.8 mm and at most 2.3 mm.

[4] The golf ball of [1] above, wherein the cover has a Shore D hardness of at least 55 and at most 62.

[5]The golf ball of [1] above, wherein the solid core has a deflection when subjected to loading from an initial load of 98 N (10 kgf) to a final load of 1,275 N (130 kgf) of 2.5 to 6.0 mm.

[6] The golf ball of [1] above, wherein the interference pigment is a pearlescent pigment.

DETAILED DESCRIPTION OF THE INVENTION

The invention is described more fully below.

The golf ball of the invention is composed of a solid core of at least one layer and a cover of at least one layer.

The solid core can be formed using a known rubber material as the base material. A known base rubber such as natural rubber or a synthetic rubber may be employed. More specifically, the use of primarily polybutadiene, particularly 1,4-cis polybutadiene having a cis structure of at least 40%, is recommended. If desired, the base rubber may also be composed of, together with the foregoing polybutadiene, another rubber such as natural rubber, polyisoprene rubber or styrene-butadiene rubber.

The polybutadiene can be synthesized using a metal catalyst such as a rare-earth catalyst (e.g., a neodymium catalyst), a cobalt catalyst or a nickel catalyst.

The base rubber can have mixed therein other components, including a co-crosslinking agent, examples of which include unsaturated carboxylic acids and their metal salts; an organic filler such as zinc oxide, barium sulfate or calcium carbonate; and an organic peroxide such as dicumyl peroxide or 1,1-bis(t-butylperoxy)cyclohexane. If necessary, other components such as a commercial antioxidant may be suitably added as well.

The solid core can be formed as a single layer or as a two-layer structure having an outer layer. When a core having a two-layer structure is formed, the outer layer may be made of the same type of rubber material as the center core or a different type of rubber material.

The diameter of the solid core, while not subject to any particular limitation, is generally at least 38 mm, and preferably at least 38.4 mm, but generally not more than 39.5 mm, and preferably not more than 39.0 mm.

The deflection hardness of the solid core is described. The solid core has a deflection when subjected to loading from an initial load state of 98 N (10 kgf) to a final load of 1,275 N (130 kgf) of generally 2.5 to 6.0 mm, preferably 3.5 to 5.0 mm, and more preferably 3.8 to 4.7 mm. If the deflection is too small, the "feel" of the ball when hit with a golf club may be too hard or the period of contact between the ball and the face of the club may be so short as to result in a poor ball controllability. Too large a deflection may give the ball too soft a feel and lower the durability of the ball to cracking with repeated impact.

The solid core has a surface hardness, expressed as the Shore D hardness, of generally at least 28, preferably at least 36, and more preferably at least 39, but generally not more than 62, preferably not more than 51, and even more preferably not more than 48.

The solid core has a center hardness, expressed as the Shore D hardness, of generally at least 28, preferably at least 32, and more preferably at least 34, but generally not more than 43, preferably not more than 39, and more preferably not more than 37. If both the surface and center of the solid core are too hard, the ball may have too hard a feel when hit and the period of contact between the ball and the club face may be too short, lowering the controllability of the ball. On the other hand, if these hardness values are both too small, the feel on impact may become softer than desirable and the durability to cracking on repeated impact may decline.

The solid core is imparted with a color. Preferred colors are selected from the group consisting of pink. yellow, blue and orange. The L value, which represents lightness in the color space system for representing colors, is generally at least 50, preferably at least 60, and more preferably at least 65. If this value is too low, the color will be dark, compromising the advantages of the invention. The method by which color is imparted to the solid core may involve, for example, adding a known color pigment to the core-forming rubber composition and intimately mixing the resulting composition. No particular limitation is imposed on the known color pigment. Examples of color pigments that may be used include those bearing the trade names Resino Red K (a red pigment made by Resino Color Industry Co., Ltd.), Resin Yellow 3GR #55 (a yellow pigment made by Resino Color Industry Co., Ltd.), and Resino Blue RT-K (a blue pigment made by Resino Color Industry Co., Ltd.).

In the practice of the invention, the surface of the solid core is enclosed by a cover of one or more layers. A transparent or translucent resin material may be used as the cover layer resin material positioned as the outermost layer of the cover. An interference pigment is added to this resin material.

The resin material in the cover layer is not subject to any particular limitation, although a known thermoplastic resin may be suitably selected. It is preferable to select an ionomer resin. If necessary, various types of elastomers and additives may be added to the primary materials of the cover, provided these do not compromise the transparency. For example, when a titanium oxide powder is added in an unaccompanied form, this compromises the transparency of the overall cover, making it impossible to achieve an appearance having a silver-metallic feel. Hence, titanium oxide powder by itself cannot be used in the invention.

Use can be made of any of various interference pigments in which color develops through an interference effect by reflected light. The use of natural mica or a pearlescent pigment is especially preferred. Pearlescent pigment are broadly divided into metal oxide-coated micas, basic lead carbonate, bismuth oxychloride and natural pearl essence. Of these, the selection of a metal oxide-coated mica is preferred because such pigments are nontoxic and have the best chemical stability. Titanium dioxide or iron oxide is often used as the metal oxide; by varying the coverage (thickness of the coating layer) by the metal oxide, various colors and interference effects can be achieved. The larger the particle size of the pearlescent pigment, the greater the degree of luster that can be achieved, although a coarse-grained effect results. Conversely, a small particle size results in a lower luster, but provides a soft, fine-grained look and a greater hiding power. Accordingly, when a pearlescent pigment is used, it is necessary to suitably select the average particle size within a range that does not compromise the advantages of the invention. Specifically, the particle size is set within a range of generally 5 to 125 μm, and preferably 5 to 25 μm. To induce the development of quality colors through interference effects by reflected light, coverage by the titanium oxide in the pearlescent pigment is selected from a range of generally 25 to 70%, preferably 35 to 65%, and more preferably 40 to 60%. If this value is too small, color development by the interference effects of reflected light will be insufficient. Conversely, if the value is too large, a high-quality feel may not be achieved. Moreover, in the practice of the invention, adding a pearlescent pigment to the cover improves the scuff resistance of the ball when it is hit with a short iron or a wedge. Examples of pearlescent pigments that can be used include the commercial product made by Merck Japan Ltd. under the trade name Iriodin 211.

The amount of the above interference pigment included per 100 parts by weight of the resin material is generally at least 0.01 part by weight, preferably at least 0.05 part by weight, and more preferably at least 0.1 part by weight, but generally not more than 5 parts by weight, preferably not more than 1 part by weight, and more preferably not more than 0.5 part by weight. If the amount of interference pigment included is below the above range, color development may be inadequate. Conversely, at an amount greater than the above range, the durability of the ball to cracking on impact may worsen.

In the practice of the invention, the color difference ΔE between the surface of the ball that has been clear coated and the solid core or an inner cover layer adjacent to an outer cover layer, expressed in the Lab color system, is 30 or less, preferably 25 or less, and more preferably 20 or less. If this value is too large, any unevenness in the thickness of the cover may be immediately apparent from anomalies in the ball's appearance or color differences may arise between dimple bottoms and land areas on the surface, resulting in a loss in the high-quality feel of the ball.

When the golf ball of the invention is a multi-layer golf ball having three or more layers, it is essential for the color difference ΔE between the surface of the ball and the cover layer inside the outermost cover layer, not the surface of the solid core proper, to be within the above-mentioned range.

The above-described cover has a Shore D hardness of generally at least 55, preferably at least 57, and more preferably at least 58, but generally not more than 62, preferably not more than 61, and more preferably not more than 60. If the cover has a Shore D hardness greater than the above range, the durability of the golf ball to repeated impact may decrease and the feel of the ball on impact may be too hard. Conversely, if the cover has a Shore D hardness that is too low, the ball may have a lower rebound and may take on more spin, shortening the carry.

The cover has a thickness of generally at least 1.8 mm, preferably at least 1.9 mm, and more preferably at least 2.0 mm, but generally not more than 2.3 mm, preferably not more than 2.2 mm, and more preferably not more than 2.1 mm. A cover thickness greater than the above range may result in a diminished cover transparency, lowering the luster of the ball. Moreover, the rebound may decrease, resulting in a shorter carry. Conversely, if the cover is too thin, the ball may have a lower durability to repeated impact.

Numerous dimples of one or more type can be formed on the surface of the cover. Moreover, desired markings such as lettering or a design can be applied to the surface of the cover.

In the present invention, any of various coatings can additionally be applied to the surface of the golf ball cover. Given the need to withstand the demanding conditions of golf ball use, preferred examples include two-part curing urethane coatings, particularly non-yellowing urethane coatings. Moreover, when such a coating is used to elicit luster, should the ball surface become marred, areas lacking luster may arise on the surface, compromising the appearance of the ball.

The golf ball of the invention, so long as it is a golf ball having a solid core of at least one layer which is enclosed with one or more cover layer, may be in any of various forms, including two-piece solid golf balls and multi-piece solid golf balls which are composed of three or more pieces and include on the outside a cover formed of at least two layers. The golf ball may be manufactured by a known technique such as injection molding in which a cover resin material is injection-molded around the solid core so as to form a golf ball having one or more layers over the solid core.

The golf ball of the invention can be made in accordance with the Rules of Golf for use in competitive play, in which case the ball may be formed to a diameter of not less than 42.67 mm and a weight of not more than 45.93 g. It is recommended that the upper limit for the diameter be generally not more than 44.0 mm, preferably not more than 43.5 mm, and more preferably not more than 43.0 mm, and that the lower limit for the weight be generally not less than 44.5 g, preferably not less than 45.0 g, more preferably not less than 45.1 g, and even more preferably not less than 45.2 g.

The ball has a deflection hardness, expressed as the deformation of the ball when subjected to loading from an initial load state of 98 N (10 kgf) to a final load of 1,275 N (130 kgf), of generally 2.3 to 5.0 mm, preferably 2.8 to 4.0 mm, and more preferably 3.2 to 3.7 mm. If the amount of deformation is too small, the "feel" of the ball when hit with a golf club may be too hard or the period of contact between the ball and the face of the club may be so short as to result in a poor ball controllability. Too much deformation may give the ball too soft a feel and lower the durability of the ball to cracking with repeated impact.

The ball has an initial velocity of generally at least 76.5 m/s, preferably at least 76.8 m/s, and more preferably at least 77.2 m/s. Too low an initial velocity may result in a poor carry. To conform to the standards for balls officially approved under Royal and Ancient Golf Club of St. Andrews (R&A) rules, the initial velocity is preferably not more than 77.724 m/s.

The golf ball of the invention is stylish and conveys a sense of quality, in addition to which it also has an excellent scuff resistance. With its distinctive appearance, it is particularly suitable for use as a lady's golf ball.

EXAMPLES

Examples of the invention and comparative examples are given below by way of illustration and not by way of limitation.

Examples 1 to 3, Comparative Examples 1 and 2

Rubber compositions having the properties shown in Table 1 below were formulated, mixed using a kneader or roll mill, then manufactured into a solid core under specific vulcanizing conditions. Next, using an injection-molding mold, the cover resin materials shown in Table 1 below were injection-molded around the solid cores so as to enclose them, thereby giving the golf balls in the respective examples and comparative examples. The thickness and hardness of the resulting covers are also shown in Table 1.

TABLE 1

| | | | Example | | | Comparative Example | |
|---|---|---|---|---|---|---|---|
| | | | 1 | 2 | 3 | 1 | 2 |
| Core | Color | | pink | yellow | blue | white | pink |
| | Formulation (pbw) | BR01[1)] | 100 | 100 | 100 | 100 | 100 |
| | | Zinc acrylate | 19.5 | 19.5 | 19.5 | 19.5 | 19.5 |
| | | Peroxide (1)[2)] | 0.6 | 0.6 | 0.6 | 0.6 | 0.6 |
| | | Peroxide (2)[3)] | 0.6 | 0.6 | 0.6 | 0.6 | 0.6 |
| | | Antioxidant[4)] | 0.1 | 0.1 | 0.1 | 0.1 | 0.1 |
| | | Zinc oxide | 27.2 | 27.2 | 27.2 | 27.2 | 27.2 |
| | | Organosulfur compound[5)] | 0.1 | 0.1 | 0.1 | 0.1 | 0.1 |
| | | Red pigment[6)] | 0.2 | 0 | 0 | 0 | 0.2 |
| | | Yellow pigment[7)] | 0 | 0.2 | 0 | 0 | 0 |
| | | Blue pigment[8)] | 0 | 0 | 0.1 | 0 | 0 |
| | Vulcanization method (temperature, time) | | 155° C., 15 min | 155° C., 15 min | 155° C., 15 min | 155° C., 15 min | 155° C., 15 min |
| Cover | Formulation (pbw) | Himilan 1557 | 50 | 50 | 50 | 50 | 50 |
| | | Himilan 1601 | 50 | 50 | 50 | 50 | 50 |
| | | Iriodin 211[9)] | 0.15 | 0.15 | 0.15 | 0 | 0 |
| | | Titanium oxide | 0 | 0 | 0 | 0 | 3 |
| | Sheet hardness (Shore D) | | 60 | 60 | 60 | 60 | 60 |
| | Thickness (mm) | | 2.1 | 2.1 | 2.1 | 2.1 | 2.1 |

Note:
The main materials in the table are described more fully below.
[1)]A butadiene rubber produced by JSR Corporation under the trade name BR01.
[2)]Peroxide (1) is dicumyl peroxide produced by NOF Corporation under the trade name Percumil D.
[3)]Peroxide (2) is 1,1-bis(t-butylperoxy)-3,3,5-trimethylcyclohexane produced by NOF Corporation under the trade name Perhexa 3M-40.
[4)]Produced by Ouchi Shinko Chemical Industry Co., Ltd. under the trade name Nocrac NS-6.
[5)]Zinc pentachlorothiophenol
[6)]Produced by Resino Color Industry Co., Ltd. under the trade name Resino Red K.
[7)]Produced by Resino Color Industry Co., Ltd. under the trade name Resino Yellow 3GR #55.
[8)]Produced by Resino Color Industry Co., Ltd. under the trade name Resino Blue RT-K.
[9)]A pearlescent pigment produced by Merck Japan Ltd. under the trade name Iriodin 211.

The physical properties of the solid cores and golf balls obtained in each of the above examples and comparative examples were measured as described below, and the color tone and appearance of the balls were evaluated under the following criteria. The results are presented in Table 2.

Core Deflection Hardness

The core deflection hardness was measured as the amount of deflection (mm) by the solid core when it was subjected to an increase in load from an initial load state of 98 N (10 kgf) to a final load of 1,275 N (130 kgf).

Shore D Hardness of Core Surface and Center

Both hardnesses were measured as the Shore D hardness (using a type D durometer in accordance with ASTM-2240).

The surface hardness was obtained by measurement with the durometer set perpendicular to the surface of the core.

The center hardness was obtained by cutting the core in half and measuring the hardness at the center of the cut surfaces on the hemispheres.

Ball Deflection Hardness

The ball deflection hardness was measured as the amount of deflection (mm) by the ball when it was subjected to an increase in load from an initial load state of 98 N (10 kgf) to a final load of 1,275 N (130 kgf).

Initial Velocity

The initial velocity was measured using an initial velocity measuring apparatus of the same type as the USGA drum rotation-type initial velocity instrument approved by the R&A. The ball was temperature conditioned at 23±1° C. for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity of the ball. This cycle was carried out over a period of about 15 minutes. The results are shown in Table 2.

Ball Color and Color Changes

The color of the ball according to the Lab color system was measured using a multiple light source spectrocolorimeter made by Suga Test Instruments Co., Ltd.

Flight

The total distance traveled by the golf ball when hit at a head speed (HS) of 35 m/s with a No. 1 wood (Tour Stage V36; loft angle, 10.5°; shaft, R) mounted on a swing robot was rated according to the following criteria.

Good: Total distance of 165 m or more

NG: Total distance of less than 165 m

Feel

The feel of the ball when hit was sensory evaluated according to the following criteria by ten amateur women golfers having head speeds of 30 to 40 m/s.

Good: Judged to be good by seven or more golfers.

Fair: Judged to be good by four to six golfers.

NG: Judged to be good by three or fewer golfers.

Scuff Resistance

The ball was hit once at a head speed of 33 m/s with a non-plated pitching wedge (PW) mounted on a swing robot, and the surface state of the ball after being hit was rated according to the following criteria by ten amateur women golfers.

Good: Six or more of the ten golfers thought the ball could be used again.

NG: Six or more of the ten golfers thought the ball was no longer fit for use.

Ball Appearance

Impressions of the ball's appearance were gathered aurally from ten amateur women golfers, based on which the appearance was rated according to the following criteria.

Good: Seven or more of the ten golfers felt the ball to be very stylish and finished to an appearance that gives it a soft, pastel look.

Fair: Four to six of the ten golfers felt the ball to be very stylish and finished to an appearance that gives it a soft, pastel look.

NG: Three or fewer of the ten golfers felt the ball to be very stylish and finished to an appearance that gives it a soft, pastel look.

TABLE 2

| | | | Example | | | Comparative Example | |
|---|---|---|---|---|---|---|---|
| | | | 1 | 2 | 3 | 1 | 2 |
| Core color | L1 | | 70.2 | 92.5 | 67.1 | 97.3 | 70.2 |
| | a1 | | 42.0 | −9.6 | −5.7 | 1.2 | 42.0 |
| | b1 | | 3.9 | 44.1 | −36.3 | 2.7 | 3.9 |
| Core properties | Diameter (mm) | | 38.55 | 38.55 | 38.55 | 38.55 | 38.55 |
| | Weight (g) | | 35.5 | 35.5 | 35.5 | 35.5 | 35.5 |
| | Deflection hardness, 10–130 kgf (mm) | | 4.5 | 4.5 | 4.5 | 4.5 | 4.5 |
| | Shore D hardness at core surface | | 41 | 41 | 41 | 41 | 41 |
| | Shore D hardness at core center | | 34 | 34 | 34 | 34 | 34 |
| Ball | Diameter (mm) | | 42.7 | 42.7 | 42.7 | 42.7 | 42.7 |
| | Weight (g) | | 45.4 | 45.4 | 45.4 | 45.4 | 45.6 |
| | Deflection hardness, 10–130 kgf (mm) | | 3.6 | 3.6 | 3.6 | 3.6 | 3.6 |
| | Initial velocity (m/s) | | 77.3 | 77.3 | 77.3 | 77.3 | 77.3 |
| Ball color | Lightness | L2 | 67.1 | 82.3 | 66.1 | 87.6 | 95.1 |
| | | a2 | 30.4 | −4.2 | −1.2 | −0.1 | 0.1 |
| | | b2 | 0.3 | 29.1 | −23.2 | 0.3 | −7.6 |
| Color | ΔL | L2 − L1 | −3.1 | −10.2 | −1.1 | −9.7 | 24.9 |

TABLE 2-continued

| | | | Example | | | Comparative Example | |
|---|---|---|---|---|---|---|---|
| | | | 1 | 2 | 3 | 1 | 2 |
| change | Δa | a2 − a1 | −11.5 | 5.4 | 4.5 | −1.3 | −41.8 |
| | Δb | b2 − b1 | −3.7 | −15.0 | 13.1 | −2.4 | −11.6 |
| | ΔE | | 12.5 | 18.9 | 13.9 | 10.1 | 50.0 |
| Flight | | | good | good | good | good | good |
| Feel | | | good | good | good | good | good |
| Scuff resistance | | | good | good | good | NG | NG |
| Appearance | | | good | good | good | fair | NG |

As shown in Table 2, the golf balls obtained in Examples 1 to 3 according to the invention each had an excellent flight, feel on impact and scuff resistance. Moreover, because an interference pigment in which color develops through an interference effect by reflected light has been added to the cover, these balls exhibited a distinctive appearance that was stylish and had a sense of quality.

In the golf ball obtained in Comparative Example 1, because an interference pigment in which color develops through an interference effect by reflected light was not added to the cover, the appearance lacked a sufficient sense of quality. Moreover, the color surface had a poor scuff resistance.

In the golf ball obtained in Comparative Example 2, because an interference pigment in which color develops through an interference effect by reflected light was not added to the cover and titanium oxide was added, the golf ball looked white and did not have a high-quality appearance.

The invention claimed is:

1. A golf ball comprising a solid core of at least one layer and a cover of at least one layer, wherein the solid core or an inner cover layer adjacent to an outer cover layer has an L value of at least 50 and has a color difference ΔE with a ball surface of at most 30, and at least the outer cover layer is transparent or translucent and made primarily of an ionomer resin that includes an interference pigment in which color develops through an interference effect by reflected light.

2. The golf ball of claim 1, wherein the solid core has a color selected from the group consisting of pink, yellow, blue and orange.

3. The golf ball of claim 1, wherein the cover has a total thickness of at least 1.8 mm and at most 2.3 mm.

4. The golf ball of claim 1, wherein the cover has a Shore D hardness of at least 55 and at most 62.

5. The golf ball of claim 1, wherein the solid core has a deflection when subjected to loading from an initial load of 98 N (10 kgf) to a final load of 1,275 N (130 kgf) of 2.5 to 6.0 mm.

6. The golf ball of claim 1, wherein the interference pigment is a pearlescent pigment.

7. The golf ball of claim 1, wherein the golf ball is two-piece solid golf ball.

8. The gold ball of claim 1, wherein a particle size of the interference pigment is within a range of 5 to 25 μm.

9. The golf ball of claim 1, wherein the interference pigment is metal oxide-coated micas.

10. The golf ball of claim 9, wherein a coverage by the metal oxide in the interference pigment is within a range of 25 to 70%.

11. The golf ball of claim 10, wherein the metal oxide of the metal oxide-coated micas is titanium dioxide.

* * * * *